United States Patent [19]

Mecke et al.

[11] Patent Number: 4,938,617

[45] Date of Patent: Jul. 3, 1990

[54] THERMAL TRANSFER RIBBON WITH ADHESION LAYER

[75] Inventors: Norbert Mecke, Hanover; Heinrich Krauter, Neustadt, both of Fed. Rep. of Germany

[73] Assignee: Pelikan Aktiengesellschaft, Hanover, Fed. Rep. of Germany

[21] Appl. No.: 375,404

[22] Filed: Jun. 30, 1989

[30] Foreign Application Priority Data

Jun. 30, 1988 [DE] Fed. Rep. of Germany ..... 3822163

[51] Int. Cl.[5] ..... B41J 3/20; B41J 31/06; B41M 5/00

[52] U.S. Cl. ..... 400/241.4; 427/148; 428/488.4; 428/354; 428/355; 428/343; 428/913; 428/914

[58] Field of Search ..... 400/241, 241.1, 210, 400/241.4; 427/146, 148; 428/913, 914, 343, 346, 348, 354, 355, 332, 484, 488.4, 200

[56] References Cited

U.S. PATENT DOCUMENTS

| | | | |
|---|---|---|---|
| 3,989,131 | 11/1976 | Knirsch et al. | 400/120 |
| 4,400,100 | 8/1983 | Aviram et al. | 400/241.1 |
| 4,541,340 | 9/1985 | Peart et al. | 101/32 |
| 4,592,946 | 6/1986 | Shuman | 428/488.4 |
| 4,687,360 | 8/1987 | Wellman | 400/241.1 |
| 4,687,701 | 8/1987 | Knirsch et al. | 400/241.1 |
| 4,698,405 | 10/1987 | Runavot et al. | 526/347 |
| 4,744,685 | 5/1988 | Mecke et al. | 400/241.4 |
| 4,833,021 | 5/1989 | Shimura et al. | 400/241 |
| 4,880,324 | 11/1989 | Sato et al. | 400/241 |
| 4,883,379 | 11/1989 | Fukuda et al. | 400/241.1 |

FOREIGN PATENT DOCUMENTS

| | | |
|---|---|---|
| 0137741 | 4/1985 | European Pat. Off. . |
| 0206036 | 12/1986 | European Pat. Off. . |
| 3507097 | 9/1985 | Fed. Rep. of Germany . |

*Primary Examiner*—Eugene H. Eickholt
*Attorney, Agent, or Firm*—Herbert Dubno

[57] ABSTRACT

A thermocarbon ribbon having a foil-type carrier and a color transfer layer or melt color has its adhesion for the the paper substrate increased by an adhesion coating applied to the color transfer layer. The adhesion layer consists of a parafin wax matrix in which a sticky hydrocarbon resin is dispersed in finely divided form so that during printing, when the temperature of the adhesion layer is raised, the paraffin wax melts, dissolves the finely divided hydrocarbon resin and allows the sticky characteristic of the latter to increase adhesion of the color transfer material to the paper.

9 Claims, 1 Drawing Sheet

THERMAL TRANSFER RIBBON WITH ADHESION LAYER

Cross-Reference to Related Applications

This application is related to the following commonly-owned copending applications: U.S. application Ser. Nos. 06/829,834 filed 14 Feb. 1986 and now abandoned; 07/109,489 filed 15 Oct. 1987 now U.S. Pat. No. 4,895,465; 07/152,641 filed 5 Feb. 1988 and now abandoned; 7/154,651 filed 10 Feb. 1988 now U.S. Pat. No. 4,998,486; 07/234,970 filed 19 Aug. 1988; 7/272,599 filed 16 Nov. 1988; and 07/351,624 filed 12 May 1989.

Field of the Invention

Our present invention relates to a thermal-transfer ribbon, i.e. a ribbon which carries a color-transfer layer in a foil or like support and is capable, upon local heating and the application of pressure from a symbol-generating printhead, to cause a symbol formed by the transfer layer to adhere to a substrate, such as a paper sheet, which may be displaced past the printing location on a platen of a thermal printer or the like. More particularly, the invention relates to a thermocolor ribbon and especially a thermocarbon ribbon, having a melt color layer applied to one side of a carrier and which is designed to be locally melted and to adhere to the substrate to leave a symbol imprinted thereon.

Background of the Invention

Thermocolor ribbons have long been known. They comprise a foil-like carrier, hereinafter referred to also as a support strip, of paper, a plastic or the like and a melt color layer on this support strip, especially in the form of a plastic-bonded and/or wax-bonded coloring agent or carbon black layer.

The melt color, during the use of a thermocolor ribbon, is melted by a heatable printing head and transferred to a writing or printing paper.

Thermal printers or heated printing heads which can be used for this purpose are described, for example, in the German Published Applications DE-AS 2 062 494 and DE-AS 2,224,445.

In the heated printing head of the printer, heated pins can generate symbols which can be formed on the receiving paper sheet in the form of alphanumeric characters or the like. The heated printing head presses against the thermocarbon ribbon and presses the latter against the paper which is to receive the imprint. The heated character of the of the printing head at a temperature of about 400° C. causes a melting of the melt color in the heated region and, because this ribbon is in contact with the paper sheet, transfers an image of the symbol to the latter. The used part of the thermocolor ribbon can be taken up on a spool.

The thermocolor ribbon can have a variety of melt colors lying next to one another and adapted to be imprinted in the same region. With the combination of the basic colors blue, yellow and red, for example, colored imprints with a full range of colorations may be made. Indeed, the use of such ribbons allows the formation of color images which have the advantage over color photography in that time consuming development and fixing steps can be eliminated.

Thermal printers operate with high writing speeds and, for example, a DIN (German industrial standard) A4 sheet can be printed in about 10 seconds without serious noise pollution.

Thermocolor ribbons may also be of the type in which a resistance heating brings about the melting of the melt color. In that case, the melt color and/or the carrier may be electrically conductive and the resistance heat serves to melt the function layer which is the melt color, to enable the transfer of symbols to the substrate.

The ribbons of this type are known as ETR materials (electrothermal ribbons) and a thermal transfer printing system using these principles is described, for example, in U.S. Pat. 4,309,117.

In both of the aforedescribed thermal transfer systems, the print sharpness (resolution) and the optical density of the transferred image depend, inter alia, upon the adhesion of the melt color to the paper. This adhesion to the paper is proportional to the adhesion surface area (i.e., the actual area of contact of the melt color and the paper) and the adhesion force.

With rough paper, the adhesion area is small since practically only the peaks of the paper surface are wetted with the molten melt color.

This problem has been recognized in the Europatent Publication EP-A-0 137 532 and German Patent Document DE-A 3 507 097. These patent documents provide on the layer of the melt color, a so-called filling layer which, when the the melt color layer becomes molten, has an extremely low viscosity and during the print process is capable of flowing into the valleys of the rough paper surface, thereby increasing the adhesion area.

This system has the drawback that with very smooth paper having a roughness in excess of 200 BEKK, the molten filling layer cannot penetrate into the paper during the printing process. Instead, the filling layer remains as layer between the paper surface and the color layer and thereby becomes a kind of hold-off layer as is described in Europatent Publication EP-A-0 042 954.

A hold-off layer has a detrimental effect on the permanence of the copy made, since it prevents permanent or long-term adherence of the melt color to the paper and any penetration of the melt color into the paper.

Hold-off layers are desirable for correction-type thermocarbon ribbons. But, for permanent document-validating prints, a hold-off layer effect is highly undesirable.

Objects of the Invention

It, therefore, the principal object of the present invention to provide a thermal transfer ribbon whereby the aforedescribed drawbacks are avoided.

Another object of the invention is to provide a thermal transfer ribbon which has improved adhesion both to rough and to smooth paper and is capable of making a permanent print, i.e. a print which cannot be erased or modified without trace.

It is also an object of our invention to an improved method of making a thermal transfer ribbon with the advantages over the prior art, that the print is permanent and has greater adhesion both to rough and smooth paper.

Summary of the Invention

These objects and others which will become more readily apparent hereinafter are attained, in accordance with the present invention, by providing on the color transfer layer, i.e. the melt color. An adhesion layer which promotes adhesion to the paper substrate and comprises a sticky hydrocarbon resin in finely divided form embedded in a paraffin.

More particularly, the thermal transfer ribbon comprises:

a support strip;

a meltable color-transfer layer on a side of the support strip and adapted to be transferred to a substrate upon heating to imprint a symbol on the substrate; and an adhesion layer on the color-transfer layer and promoting adhesion of the color-transfer layer to the substrate, the adhesion layer comprising a sticky hydrocarbon resin embedded in finely divided form in a paraffin.

In the following description, it will be understood that the support strip or carrier may be any of the carrier foils described in the aforementioned copending applications and the color transfer layers or melt color layers may be any of the melt colors described in the aforementioned copending applications.

It is important for the invention that the adhesion layer, which comprises as a matrix phase, a paraffin, has a sticky hydrocarbon resin in finely divided form embedded and dispersed therein.

The term hydrocarbon resin is a term describing a thermo-plastic, low molecular weight (molecular weight generally below 2000) polymers which have been used heretofore, among other things, for the modifying of adhesives or as tacky or sticky producing substrates for chewing gum (e.g. tarpene resins).

Among the oldest of the hydrocarbon resins are the cumarone-indene resins derived from bituminous coal tar distillation. From crude oil cracking, petroleum resins are obtainable which can contain or consist of $C_4$–$C_6$ alkene fractions, $C_8$–$C_{10}$ aromatic fractions (indene toluenes, vinyl toluenes, styrenes and homologs thereof) or the dicyclopentadiene fraction.

The terpene resins can include dipentene, pinenene and limonene, etc. as well as terpene hydrocarbons which can be obtained, for example, in the production of terpene-free etheric oils or from cellulose as sulfate terpentines by cationic polymerization.

Newer developments use pure monomers, mainly styrene or alkyl styrenes and similar compounds which are copolymerized. It will be self-understood that under the designated hydrocarbon resins, also fall aliphatic structures with a sticky texture. The hydrocarbon resins can also include aromatic, aliphatic, alicyclic and mixed hydrocarbons as are used as modifiers for adhesives and especially pressure adhesives and melt adhesives.

It is apparent, therefore, that the above-described group of hydrocarbon resins is only given by way of example and should not be considered a limitation on the class definition. Indeed, there are a large number of hydrocarbons resins which, if they have a sticky texture can be dispersed in the paraffin and have their stickiness masked by the paraffin until the paraffin melts, can be used in accordance with the principles of the invention.

The main component of the adhesion layer of the thermal transfer ribbon of the invention is a paraffin. The term "paraffin" is used in the sense of the invention can be a solid (at room temperature) mixture of purified, satisfied aliphatic-hydrocarbons which is colorless, odorless and tasteless easily soluble in ether and chloroforml and insoluble in water and 90% ethanol. It is a solid material having a hardening temperature in a range of about 50 to 110° C., preferably between about 60 to 95° C. The paraffins preferably are microcrystalline waxes, cerasin waxes, petroleum wax and Fischer-Tropsch-waxes.

Preferably, the adhesion layer contains the sticky hydrocarbon resin in an amount of about 10 to 45% by weight. The thickness of the adhesion layer can vary widely. Preferably, it is about 0.2 to 10 micrometers, especially 1 to 3 micrometers.

The lower limitation is determined by the practicalities of coating technology and cannot be lowered further without causing nonuniform coating. There is no value to be obtained by exceeding the upper limit set forth above and there is the disadvantage that it greatly increases the cost of production, requires higher energy for the printing process and generally gives rise to unsatisfactory results. Basically, the particular layer thickness of the adhesive layer is not critical within the range recited and to achieve the desired results of the invention.

A variety of additives can be incorporated into the adhesion layer to obtain additional effects. For example, it can include coloring agents, other waxes, especially ester waxes which improve the writability of overhead foils, inert fillers and the like.

The formation of the adhesion layer on the melt color of the thermal transfer ribbon of the invention can be brought about by doctoring a mixture of molten paraffin in which the sticky hydrocarbon resin is dispersed on the color transfer layer by conventional technology processes, for example a doctor blade. The temperature of the adhesion layer can be, as a rule, between 100 and 130° C. and the coating material can then be cooled.

While we do not wish to be bound to any particular theory for the unique effects of the invention, we believe that the key point to the invention is that the adhesion of the melt color utilizing the ribbon of the invention is not improved by increasing the adhesion surface, but rather by increasing the adhesion forces.

Furthermore, since the thermal transfer ribbon must have a shelf life of the order of years, even when exposed to temperatures above 50° C., the adhesion promoter cannot be activated during this long-term storage or by ambient temperatures.

Normally, a sticky hydrocarbon resin cannot be used directly on the color transfer layer to increase the adhesion forces since this sticky material would cause the turns of the ribbon to stick together.

We have found, to our surprise, that the paraffin apparently masks the sticky hydrocarbon resin of the adhesion layer so that even with long-term storage of the ribbon at temperatures above 50° C., the sticky material cannot cause the turns of the ribbon to stick together. The masking effect appears to be achieved by embedding the particles of the sticky hydrocarbon resin in the paraffin matrix.

Only when the adhesion layer is raised to a temperature above the melting point of the adhesion layer which is primarily determined by the melting point of the paraffin, can the sticky hydrocarbon resin by homogenously solubilized in the paraffin so that it can exert an adhesion effect only during the printing processes.

Sticky hydrocarbon resins of the above-described type which, for example, are used in the manufacture of melt and tacky adhesives, when solubilized in paraffin have a temperature-dependent solubility equilibrium. This characteristic makes the invention possible.

At temperatures above the melting point of the hydrocarbon resin/paraffin mixture, the hydrocarbon resin is homogenously dissolved in the paraffin. On cooling the hydrocarbon resin tends to be dispersed in the paraffin matrix before the hardening point is reached.

Thus if the melt which forms the adhesion layer is applied to the color transfer layer, during cooling the hydrocarbon resin will disperse in finely divided form and become embedded in the paraffin matrix. The adhesion layer is thus neither tacky nor sticky and the adhesion effect of the hydrocarbon resin is effectively masked.

Only during the printing process is the hydrocarbon resin redissolved and again enabled to exercise an adhesion effect upon the paper and the color transfer material to retain the latter with greater force upon the paper. Naturally, when considering the addition of the additives to the adhesion layer, one must be concerned with how they may effect the temperature-dependent solubility equilibrium of paraffin an hydrocarbon resin.

Brief Description of the Drawing

The above objects, features and advantages of our invention will become more readily apparent from the following description, the sole FIGURE of which is a perspective view showing a ribbon according to the invention partly broken away.

Specific Description

Figure 1:
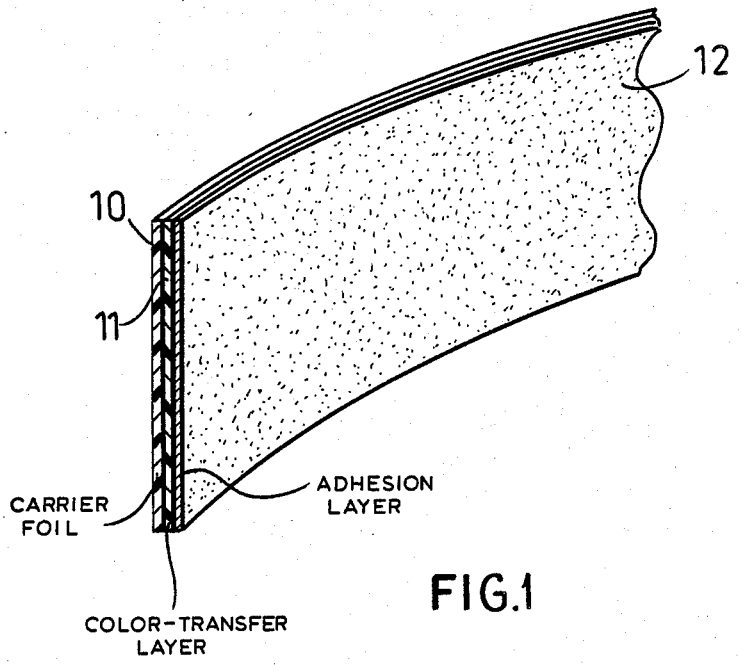

The ribbon shown in the drawing comprises a support strip 10 of any of the foil support or carrier materials described above formed with a color transfer layer or melt color layer 11 and the adhesion layer 12 as described above and in the following examples.

Example 1

A thermal transfer ribbon is made by applying to a polyester foil carrier a color transfer layer in a thickness of 5 micrometers of 45% by weight paraffin having a melting point of about 68° C., 40% by weight ethylenevinylacetate and 15% by weight carbon black.

To this color transfer layer an adhesion layer is applied of the following composition: 3.5 parts by weight paraffin with a melting point of about 68° C., 0.5 parts by weight of an ester Wax and 1.0 parts by weight of a hydrocarbon resin having a melting point of about 120° C. (KW 61 of the firm VfT (Verkaufsgesellschaft für Teererzeugnisse mbH). The mixture has a hardening point of about 63° C. while the cloud point of the melt upon cooling is about 97° C. The material of the adhesion layer is melted and coated in a thickness of 2 micrometers with a roller on the color transfer layer. After cooling, a thermocarbon ribbon is obtained which has been found to be especially effective in the printing of rough paper with a BEKK smoothness of less than 50.

Example 2

The Example 1 is followed except that the composition of the adhesion layer was 3.0 parts by weight paraffin of a melting point of about 68° C., 1.0 parts by weight ester wax and 1.0 parts by weight of a hydrocarbon resin with a melting point of 130° C. (A 120 as marketed by Hercules). The cloud point was reached at about 110° C. upon cooling. Similar excellent results as the thermocarbon ribbon were achieved.

We claim:

1. A method of making a thermal-transfer ribbon, comprising the steps of:

(a) applying to one side of a support strip a meltable color-transfer layer adapted to be transferred to a substrate upon heating to imprint a symbol on said substrate; and (b) applying on said color-transfer layer an adhesion layer promoting adhesion of said color-transfer layer to said substrate, said adhesion layer being formed by dispersing a sticky hydrocarbon resin in finely divided form in a paraffin.

2. A thermal-transfer ribbon, comprising:

a support strip;

a meltable color-transfer layer on a side of said support strip and adapted to be transferred to a substrate upon heating to imprint a symbol on said substrate; and an adhesion layer on said color-transfer layer and promoting adhesion of said color-transfer layer to said substrate, said adhesion layer comprising a sticky hydrocarbon resin embedded in finely divided form in a paraffin.

3. The thermal-transfer ribbon defined in claim 2 wherein said adhesion layer has a thickness of about 0.2 to about 10 micrometers.

4. The thermal-transfer ribbon defined in claim 3 wherein said thickness is 1 to 3 micrometers.

5. The thermal-transfer ribbon defined in claim 2 wherein said adhesion layer further comprises an ester wax.

6. The thermal-transfer ribbon defined in claim 2 wherein said adhesion layer contains about 10 to about 45 weight percent of said hydrocarbon resin.

7. The thermal-transfer ribbon defined in claim 2 wherein said adhesion layer further comprises a coloring agent.

8. The thermal-transfer ribbon defined in claim 2 wherein said paraffin of said adhesion layer has a melting point of about 60° C. to about 95° C.

9. A thermal-transfer ribbon, comprising:

a support strip constituted of paper or a plastic foil;

a meltable color-transfer layer on a side of said support strip and adapted to be transferred to a substrate upon heating to imprint a symbol on said substrate, said color-transfer layer comprising at least one coloring agent in a meltable substance; and an adhesion layer on said color-transfer layer and promoting adhesion of said color-transfer layer to said substrate, said adhesion layer comprising a sticky hydrocarbon resin embedded in finely divided form in a paraffin, said adhesion layer having a thickness of substantially 1 to 3 micrometers, said hydrocarbon resin being a thermoplastic resin with a molecular weight below 2000, said paraffin being a colorless, odorless and tasteless mixture of saturated aliphatic hydrocarbons with a hardening temperature of about 50 to 110° C., said sticky hydrocarbon resin being present in an amount of about 10 to about 45 weight percent of said adhesion layer.

* * * * *